US006877748B1

(12) United States Patent
Patroni et al.

(10) Patent No.: US 6,877,748 B1
(45) Date of Patent: Apr. 12, 2005

(54) METHOD FOR PLAYING MODIFIED BLACKJACK WITH POKER OPTION

(76) Inventors: Anthony F. Patroni, 9005 Amherst Ave., Margate, NJ (US) 08402; Patricia D. Patroni, 9005 Amherst Ave., Margate, NJ (US) 08402

( * ) Notice: Subject to any disclaimer, the term of this patent is extended or adjusted under 35 U.S.C. 154(b) by 0 days.

(21) Appl. No.: 10/719,190

(22) Filed: Nov. 21, 2003

Related U.S. Application Data

(60) Provisional application No. 60/428,813, filed on Nov. 25, 2002.

(51) Int. Cl.[7] ..... A63F 1/00
(52) U.S. Cl. ..... 273/292; 273/274
(58) Field of Search ..... 273/292, 274, 273/309, 303–306; 463/12, 13

(56) References Cited

U.S. PATENT DOCUMENTS 5,947,822 A * 9/1999 Weiss ..... 463/13
6,131,908 A * 10/2000 Palmer ..... 273/292
6,179,711 B1 * 1/2001 Yoseloff ..... 463/25
6,609,711 B1 * 8/2003 Campbell ..... 273/274
6,749,200 B1 6/2004 Yurkins

FOREIGN PATENT DOCUMENTS

GB 2216322 A * 10/1989 ..... G07F/17/32

* cited by examiner

*Primary Examiner*—Benjamin Layno
(74) *Attorney, Agent, or Firm*—Raymond A. Nuzzo

(57) ABSTRACT

A card game wherein a player has the choice of playing the player's initial hand of cards as either a poker hand or a modified blackjack hand. If the player elects to play the hand as a poker hand, the player will win if he or she acquires a poker hand that matches one of a plurality of predetermined poker hands. If the player elects to play the hand as modified blackjack hand, the player wins if the player acquires a hand that qualifies as a winning hand. If the player wins, the player has the option of playing the dealer in a second type of card game wherein the player has the option of wagering all of his or her winnings ("Double Down") or wagering only half of his or her own winnings ("Half Down").

9 Claims, 1 Drawing Sheet

METHOD FOR PLAYING MODIFIED BLACKJACK WITH POKER OPTION

CROSS-REFERENCE TO RELATED APPLICATIONS

This application is related to and claims the benefit of the filing date of commonly owned and copending U.S. provisional patent application Ser. No. 60,428,813, filed Nov. 25, 2002. This application is also related to Disclosure Document No. 505872, filed Feb. 25, 2002.

BACKGROUND OF THE INVENTION

1. Field of the Invention

The present invention generally relates a method for playing a card game.

2. Description of Related Art

Currently, casinos use a variety of games for wagering. Many of these games are varieties of mechanical or electronic slot machines. Despite the popularity of slot machines, poker, blackjack, keno, baccarat, craps and other traditional games played at a table are the foundation of casino play. Players are known to enjoy the novelty of new table games because the old games have become too well known by the players or because the players perceive some of the traditional games as being overly complicated. Moreover, since table games usually have larger stakes than slot machines, casinos have an interest in developing new table games for the clientele. Card games are one of the most popular types of table games available at casinos. Prospective players are always looking for new card games that are challenging and exciting. On the other hand, casinos and wagering establishments are interested in card games that will attract more players, create player loyalty, and increase revenues to the casinos and wagering establishments.

The game of "blackjack" or "twenty-one" is perhaps the most popular card game played in casinos throughout the United States. This game is typically played with a standard deck of playing cards containing fifty-two cards in four different suits. The object of the game is for each player to collect a number of cards in his or her hand whereby the total point value assigned to the cards in a player's hand is as close as possible to twenty-one without going over. Numbered cards (i.e., 2–10) are assigned a numerical value equal to their face value and face cards (i.e., king, queen and jack) are assigned a numerical value of ten points each. An ace card may be assigned either a point value of one or eleven--whichever value gives a more favorable hand to the player. If the point value in a player's hand exceeds twenty-one points, the player "busts" and is eliminated from further play until a winner is declared and the next hand is dealt. Blackjack is typically played at tables that include a location for a dealer and up to seven additional players. Each player places a wager and, along with the dealer, initially receives two cards. In traditional blackjack, each player is playing against the dealer or "house". The dealer or house acts as the bank, paying all losses and collecting all winnings from the other players at the table. In order to win his or her wager, the cards in a player's hand must have a higher total point value than the total point value in the dealer's hand without: going over twenty-one points. During a player's turn, a player may elect to draw additional cards (i.e., take a "hit") or play only the cards currently held in his or her hand (i.e. "stand"). A player may continue to receive additional cards in order to try to reach a point total of twenty-one without exceeding twenty-one. It is not necessary to reach twenty-one points to win a game; it is only necessary to come closer to twenty-one points than the dealer. Since the dealer receives one of his two initial cards facedown (i.e., a "hole" card), the players know only half of the cards in the dealer's initial hand. This adds an element of uncertainty to a player's decision to take a hit or stand.

The risk of losing a hand by exceeding twenty-one points (i.e., "busting") by taking an additional card increases as the point total of the cards in the player's hand approaches twenty-one. A player increases the probability of beating the dealer's card total by selectively and strategically hitting or standing on a particular card situation. Under most house rules, the dealer must take a hit on any point total of sixteen or less and must stand on any point total of seventeen or more. Any player whose hand has a point total that does not exceed twenty one and is closer to twenty-one than the dealer, wins his or her wager. Conversely, each player who "busts" or who does not achieve a higher point total than the dealer loses the hand and the corresponding wager for that hand. Even if the dealer also busts, the player still loses when the player busts.

A "blackjack" occurs when a player or the dealer receives an ace and a face card or ten. A blackjack by the dealer ends the game, causing all other players to lose their wagers. A blackjack for a player is the best possible hand for the player and beats the dealer unless the dealer also has a blackjack. Ties between the player and the dealer are a "push" and are typically won by the house. Players at a blackjack table will typically play multiple successive hands and players may enter and leave the game at any time between hands. After all of the players have taken hits or have stood on their hand, the dealer stands or hits based on pre-established rules of the game. The conventional manner of play requires the dealer to take a hit whenever the dealer's hand is a "soft 17" count. However, in other casinos, the dealer stands on a soft 17 count. The term "soft" means that the ace is valued as a count of eleven, instead of as a count of one. A soft 17 occurs when the dealer has an ace and a six (or multiple cards that add up to six). The dealer will stand on soft 18*s*, soft 19*s* and soft 20*s*.

A drawback with traditional forms of blackjack is that the set point values of the cards may make the game somewhat predictable so as to eventually bore players after a few hands. Moreover, there is no incentive built-into the game for playing additional hands beyond other than the usual reasons of winning money or recouping money lost in previous wagers.

There is a need to provide a modified version of blackjack that generates additional unpredictability, excitement, and revenue for both players and casinos relative to traditional forms of blackjack.

SUMMARY OF THE INVENTION

It is an object of the present invention to provide a modified version of blackjack that generates additional unpredictability, excitement, and revenue for both players and casinos relative to traditional forms of blackjack.

It is another object of the present invention to provide a new card game that attracts more players.

It is another object of the present invention to provide a new card game that is easy to learn.

It is another object of the present invention to provide a new card game that is short in duration so as to provide casinos or wagering establishments with increased revenues.

Other objects and advantages of the present invention will be apparent to one of ordinary skill in the art in light of the ensuing description of the present invention.

As used herein, the term "modified blackjack" refers to the card game of the present invention wherein the object of the game is for each player to collect a number of cards in his or her hand whereby the total point value assigned to the cards in a player's hand is as close to possible to a predetermined number, other than twenty-one, without going over that predetermined number. In one embodiment, the predetermined number is 31. In another embodiment, the predetermined number is 41. In a further embodiment, the predetermined number is 51. The modified blackjack card game of the present invention provides a player with the option of declaring his initial hand either as a poker hand or a modified blackjack hand. This feature is described in detail in the ensuing description.

The present invention is directed to, in one aspect, a method of playing a card game comprising the steps of providing at least one set of playing cards wherein each card in the set of playing cards has a specific numeric value. Next, a wager is placed by at least one player and an initial hand of cards is dealt to the player and the dealer. The player's cards are dealt face up and at least one of the dealer's cards is dealt face down. The player then has the opportunity to declare his hand as either a poker hand or a modified blackjack hand. If the player declares his or her hand as a poker hand, the player will receive additional cards to enable the player to finish his or her poker hand. The player will be awarded winnings based on the player's wager and a predetermined payout schedule if the poker hand represented by the player's cards matches any one of a plurality of predetermined poker hands. If the player fails to achieve a hand that represents any one of the plurality of predetermined poker hands, the player loses his or her wager and must withdraw from play. If, on the other hand, the player does not declare his or her initial hand as a poker hand, the player is required to play the hand as a modified blackjack hand. The suits of the card would have no relevance when playing modified blackjack. Thus, after the player declares he or she will play the hand as a modified blackjack hand, the next step is to determine if the total numeric value of the player's initial hand constitutes modified blackjack. An initial hand constitutes modified blackjack if the total numeric value of the initial hand equals a first predetermined number. If the player's initial hand constitutes modified blackjack, the dealer then reveals all of the dealer's face down cards so the total numeric value of the dealer's initial hand can be determined. If the total numeric value of the dealer's initial hand also equals the first predetermined number, then the dealer's initial hand will also constitute modified blackjack and a tie or push is declared. In one embodiment, the dealer returns the player's wager to the player in the event of a tie or push. In an alternate embodiment, the player loses his or her wager in the event of a tie or push.

If the player does achieve modified blackjack with his or her initial hand and dealer does not achieve modified blackjack with his or her initial hand, the player will win and will be awarded winnings based on the player's wager and a predetermined payout schedule.

If the total numeric value of the player's initial hand does not yield modified blackjack, the player may request additional cards. The player will "bust" if the total numeric value of the player's hand exceeds the first predetermined number. The player will then lose his or her wager and withdraw from play. The dealer is required to stand on all hands which have a total numeric value that is either equal to or greater than a second predetermined number that is less than the first predetermined number. Thus, the deader must continue to take cards ("hit") until his total numeric value is equal to or greater than the second predetermined number. In one embodiment, the first predetermined number is 31 and the second predetermined number is 25. Thus, in such an embodiment, the dealer would stand on 25. Winnings are paid to the player if (a) the player's hand with the additional cards has a total numeric value that is equal to the first predetermined number and the total numeric value of the dealer's hand does not equal the first predetermined number, or (b) the player holds and the total numeric value of the player's hand is closer to the first predetermined number than the total numeric value of the dealer's hand. Winnings paid to a player are based on the player's wager and a predetermined payout schedule. A tie or push would occur if both the player and dealer have the same number of cards and the total numeric values of the player's and dealer's hands are equal to each other and either less than or equal to the first predetermined number.

In accordance with the present invention, a unique betting option is presented wherein a player has the opportunity to play the dealer in a subsequent card game and wager either half or all of his or winnings acquired in the preceding game. For example, if a player should win the first card game either through achieving a winning poker hand or winning hand in the modified blackjack card game, the player is then given the opportunity to play the dealer in a second card game (e.g. "high-low") for "double or nothing". This would give the player an opportunity to double his or her previous winnings. In accordance with the invention, the player is given the choice of wagering all of his or her previous winnings ("Double Down") or only half of his or her previous winnings. The option of betting only half of the winnings is referred to herein as the "Half-Down". The "Half-Down" option applies to all winnings that may be accumulated during play of the second card game. Thus, if a player wins $1000 as a result of the modified blackjack card game, he or she has the option of wagering the full $1000 or only $500 in a game of high-low with the dealer. If the player bets only $500 and wins, the player will receive even money (i.e. $500). Stated another way, the player will receive the original wager of $500 and the $500 payoff. The player can now play another game of high-low with the dealer using the "Double Down" or "Half-Down" options. This foregoing example was based on a "double or nothing" payout scheme.

In a further embodiment, the player may be given the choice of "Double Down" or the "Half-Down Option" when playing the modified blackjack card game.

The card game of the present invention can be played: (i) in a casino or other wagering establishment in a manner similar to conventional card games, i.e. "live table version" wherein a group of players and a dealer are positioned at a gaming table, (ii) on electronic video gaming machines such as electronic video poker gaming machines which may be located in a casino other wagering establishment, or (iii) on linked, electronic video gaming machines located in a casino or wagering establishment. The card game of the present invention also can be implemented on slot machines. Furthermore, the card game of the present invention also can be implemented with lottery scratch-type tickets that are sold by many state governments.

BRIEF DESCRIPTION OF THE DRAWINGS

The foregoing features of the present invention will become more readily apparent and may be understood by referring to the following detailed description of an illustrative embodiment of the present invention, taken in conjunction with the accompanying drawing, in which.

DESCRIPTION OF THE PREFERRED EMBODIMENTS

Figure 1:
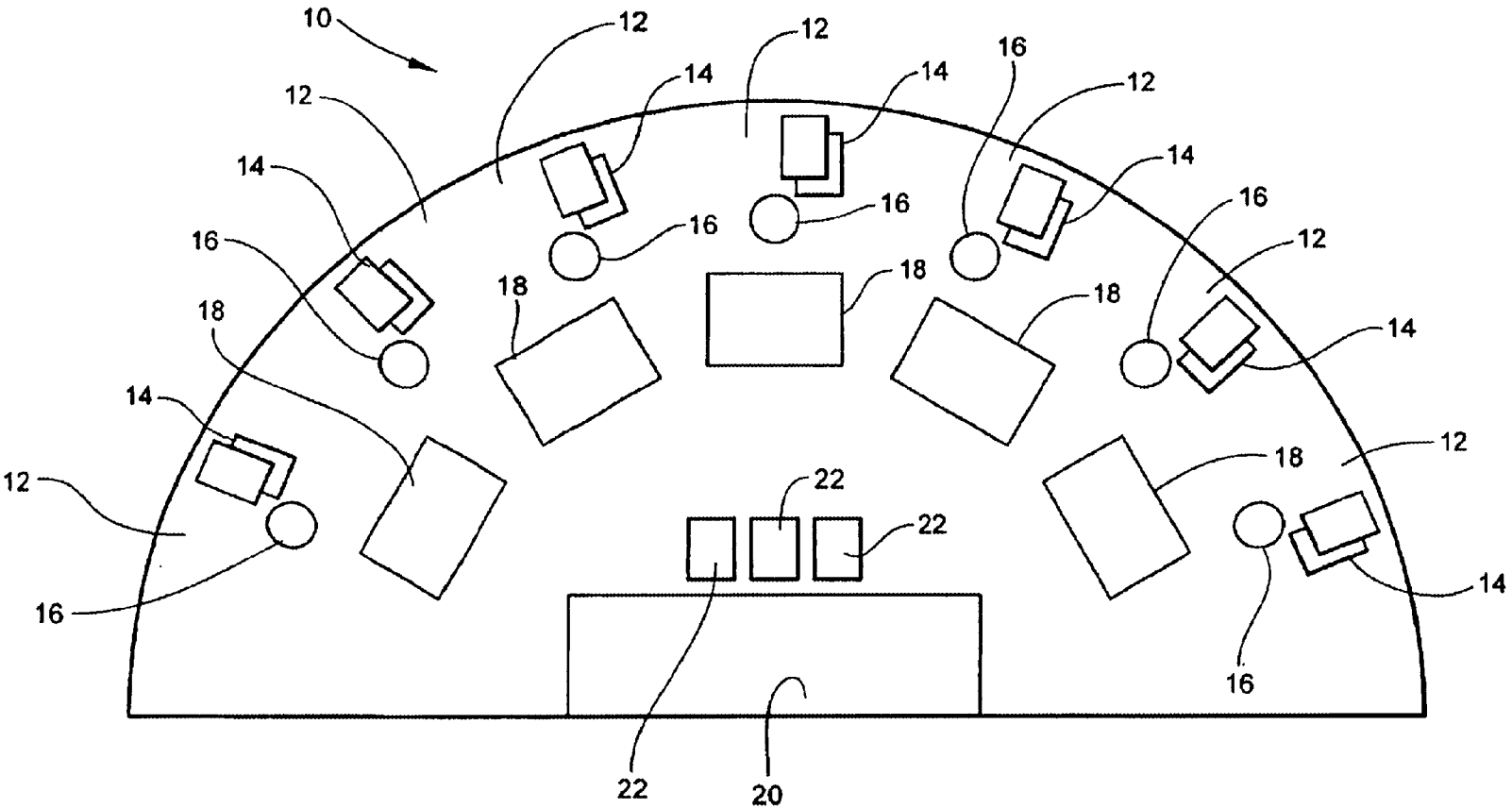
FIG. 1 shows a plan view of one embodiment of a gaming table that can be used to play the card game of the present invention.

The card game of the present invention can be played with up to seven players plus the dealer. A single player also may play the card game. The players sit at or stand adjacent to a portion of the game table designated as a player station. In one embodiment, all of the sets of cards are contained in a shoe, known in the art, from which the dealer may draw one card at a time. In another embodiment, all of the sets of cards are contained in an automatic card shuffler. As used herein, the terms "wager" and "bet" have the same meaning and are used interchangeably. Furthermore, the card game of the present invention can be implemented on an electronic gaming machine such as the type used to realize an electronic video gaming machine. In such electronic gaming machines, images of playing cards are electronically generated and then displayed on a display screen. If the card game of the present invention is implemented on an electronic gaming machine, the electronic gaming machine is preferably configured to generate a single deck of 52 cards. Additionally, the card game of the present invention can be realized with a lottery scratch ticket wherein images of playing cards are covered by a substance that is removed by players with a coin or other suitable object. U.S. Pat. No. 6,572,107 shows a typical structure of such lottery scratch-type tickets. Thus, the terms "cards", "playing cards" or "hand" are defined herein to include physical playing cards, electronically generated playing cards, and the images of playing cards formed on lottery scratch-type tickets.

Referring to FIG. 1, there is shown one embodiment of game table 10 that is used in playing the card game of the present invention. Game table 10 includes seven player stations or areas 12. Each player station 12 includes an area for placing the player's cards 14 and betting area 16. Each player's station 12 also includes payout schedule 18 that provides payout schedules corresponding to the card game of the present invention. Game table 10 includes dealer playing station or area 20 and an area wherein the dealer may place the dealer's cards 22. Although game table 10 is shown to have a semi-circular shape, it is to be understood that game table 10 can have other shapes known in the art, e.g. square, circular, rectangular, etc.

As used herein, the terms "numeric value" or "value" refer to the numeric value assigned to each playing card. In accordance with the present invention, number cards (e.g. 2, 3, 8, etc.) are assigned a numeric value that is the same as the face value of the card. For example, the "eight" card shall have a numeric value of eight. Picture or face cards such as Jack, Queen and King shall each have a numeric value of ten. The Ace shall have a numeric value of either one or eleven. In an initial hand of cards, the ace may be assigned a numeric value of eleven so as to enable a player to achieve modified blackjack. The phrase "total numeric value" shall refer to the total of the numeric values of all of the cards in a hand. For example, a hand of "Five, Eight, Nine, Queen" shall have a total numeric value of thirty two.

In accordance with the present invention, Modified Blackjack occurs when (i) the predetermined winning number is 31 and the player is dealt an initial hand of three cards that has a total numeric value of 31, or (ii) the predetermined winning number is 41 and the player is dealt an initial hand of four cards that have a total numeric value of 41, or (iii) the predetermined winning number is 51 and the player is dealt an initial hand of five cards that has a total numeric value of 51, These games will be referred to herein as "Modified Blackjack 31", "Modified Blackjack 41" and "Modified Blackjack 51", respectively. A player can also win any of these aforementioned modified blackjack games if the player has a hand of cards whose total numeric value is under and closest to the game winning numeric value (i.e. 31, 41 or 51) in comparison to the dealer's hand. For example, if Modified Blackjack 31 is being played and the dealer has a hand of cards whose total numeric value is 26 and the player has a hand of cards whose total numeric value is 29, the player will win. In another example, if the dealer has three cards whose total numeric value is 29 and the player has four cards whose total-numeric value is also 29, the dealer will win because the dealer has fewer cards than the player. The maximum number of cards that can be dealt to each player is set by the house. For purposes of example and describing the card game of the present invention, the ensuing description is in terms of the card game being Modified Blackjack 31 and minimum number of cards dealt to each player is three cards and the maximum number of cards dealt to each player is five cards. The first step in playing the card game of the present invention is to provide at least one deck of playing cards. In one embodiment, the card game of the present invention is played with more than one deck. The actual number of decks of playing cards used depends upon the number of players and the maximum number of cards that may be dealt to the players. The dealer preferably deals the cards in a left to right motion starting from the dealer's left.

Next, the player is required to place a wager. The minimum and maximum amount of the wager is determined by the house and may be varied by the house. The player places his or her wager on area 16 of the player's playing station 12 (see FIG. 1).

Next, the dealer deals the cards to the player and the dealer in an initial deal. In this step, each player and the dealer will receive three cards. In a preferred embodiment, all three cards dealt to each player are face up and one card dealt to the dealer is face down.

Next, each player is given the opportunity to decide whether he or she will play the cards dealt to the player as either a poker hand or a modified blackjack hand. If the player chooses to play his or her cards as a poker hand, the player automatically receives two additional cards to enable a player to complete a poker hand. If the player succeeds in forming a poker hand that matches any one of a plurality of predetermined poker hands, the player will win an amount of winnings that is based on the amount of the wager and a predetermined payout schedule.

Table I shows one example of a payout schedule:

TABLE I

| POKER HAND | ODDS |
|---|---|
| Pair | 1 to 1 |
| Two Pair | 2 to 1 |
| Three of a Kind | 3 to 1 |
| Straight | 5 to 1 |
| Flush | 10 to 1 |
| Full House | 15 to 1 |
| Four of a Kind | 20 to 1 |
| Straight Flush | 50 to 1 |
| Royal Flush | 100 to 1 |

It is to be understood that the payout schedule shown in Table I is just one example and that other pay-out schedules are possible. The house or casino will have the option to set all odds and values of the winning poker hands.

If the player does not choose to play the cards as a poker hand, the player must play the cards as a modified blackjack hand (e.g. Modified Blackjack 31). If the player's initial hand of three cards has a total numeric value of 31, then the player has attained Modified Blackjack 31. If the dealer's initial hand does not yield Blackjack 31, the player will win. Initial three-card hands that can achieve Modified Blackjack 31 are shown in
Table II:

TABLE II

| MODIFIED BLACKJACK 31 HANDS |
|---|
| Ten, Ten, Ace |
| Ten, Jack, Ace |
| Ten, Queen, Ace |
| Ten, King, Ace |
| Jack, Jack, Ace |
| Jack, Queen, Ace |
| Jack, King, Ace |
| Queen, Queen, Ace |
| Queen, King, Ace |
| King, King, Ace |

In Table II, Ace has a value of eleven.

Next, if the player's initial hand does not achieve Modified Blackjack 31, the player is given the opportunity to either hold or request an additional card or cards. If the player's cards have a total numeric value that still is not equal to 31, but is still under 31, the player has the opportunity to hold or request an additional card. If the player's cards have a total numeric value that exceeds 31, the player "busts" and loses his or her wagers and must withdraw from that round. If the player "busts", he or she will lose even though the dealer also "busts". A player who lost in one round may play in a new round.

Next, the dealer reveals all of his or her face-down cards. The total numeric value of the dealer's cards is then determined. In accordance with the invention, the dealer must stand on hands that have a total numeric value that is equal to or greater than a second predetermined numeric value that is less than 31. For example, in one embodiment, the second predetermined number is 25. Therefore, the dealer must take additional cards until the total numeric value of the dealer's cards equals or exceeds 25. The second predetermined numeric value can be varied and is set by the house. If at any time the total numeric value of the dealer's cards exceeds 31, the dealer "busts" and loses.

A tie or push occurs if (A) the dealer and player both have initial hands of three cards whose total numeric values are equal to 31 (i.e. Modified Blackjack 31), or (B) the dealer and player both have hands whose total numeric values are equal to 31 and the player and dealer both have the same number of cards, or (C) the dealer and player both have hands whose total numeric values are equal and less than 31 and the dealer and player both have the same amount of cards. In one embodiment of the invention, the player loses his or her wager if a tie or push occurs. In another embodiment, the player's wager is returned to the player if a tie or push occurs.

Thus, a player has a winning hand and is declared the winner if (A) the total numeric value of the player's initial hand equals 31 (i.e. Modified Blackjack 31) and the total numeric value of the dealer's initial hand does not equal 31, or (B) the total numeric value of the player's hand equals 31 and the total numeric value of the dealer's hand also equals 31 but the player has fewer cards than the dealer, or (C) the total numeric values of both the player's and dealer's hands are under 31 but the total numeric value of the player's hand is closer to 31 than the total numeric value of the dealer's hand.

A player with a winning hand is paid winnings based on the player's wager and the predetermined payout schedule. The house can set different payout odds for different types of winning hands. For example, the house can pay even money to winning hands other than winning Modified Blackjack 31 hands, and 3-to-2 pay-out odds for a winning Modified Blackjack 31 hand. These are just examples and it must be understood that the house can vary these payout odds.

In the gaming art, it is known that after a player has won a round of conventional or traditional Blackjack, the player is given the opportunity to play the dealer in a second card game, typically called "high-low". This second card game provides the player with an opportunity to add to and even double his or her winnings won during the conventional or traditional Blackjack game. The player is not required to play this second card game and may opt not to play. In the game of high-low, the dealer shows the player a card and then the player selects one card from a group of face down cards. If the card selected by the player is higher than the dealer's card, the player wins. If the card selected by the player is lower than the dealer's card, the player loses. Traditionally, in order to play the dealer in high-low, the player must wager (or "Double Down") all of his previous winnings. Thus, if the player wins, he or she wins even money. If the player loses, he or she loses everything. However, in accordance with the present invention, the player is given the choice of either wagering all of his or her previous winnings ("Double Down") or only half of the previous winnings ("Half Down"). The player may play the dealer in successive rounds of the second card game (i.e. high-low) and may bet all of his or her winnings up to that point or only half of the accumulated winnings. The player may continue to play the dealer in the second card game until the player either quits or loses all of his or her winnings. It is to be understood that the second card game can be another card game other than high-low.

In an alternate embodiment of the card game of the present invention, the dealer uses a Joker card so that a poker hand of five-of-a-kind is possible. In a further embodiment, more than one Joker card is used.

Although the foregoing description is in terms of the first redetermined number being 31, 41, or 51, it is to be understood that the first predetermined number can also be 61, 71, 81, 91, etc. For example, if the first predetermined number is 61, the minimum number of cards dealt in the initial deal is six cards. Thus, the minimum number of cards dealt in the initial deal would depend upon the first predetermined number.

It is to be understood that the card game of the present invention can be played: (i) in a casino or other wagering establishment in a manner similar to conventional card games, i.e. "live table version" wherein a group of players and a dealer are positioned at a gaming table, (ii) on electronic video gaming machines such as electronic video poker gaming machines which may be located in a casino other wagering establishment, or (iii) on linked, electronic video gaming machines located in a casino or wagering establishment. Electronic video poker gaming machines are generally described in U.S. Pat. Nos. 6,517,074, 6,478,675, and 5,823,873. The card game of the present invention also can be implemented on slot machines. Furthermore, the card game of the present invention also can be implemented with lottery scratch-type tickets that are sold by many state governments.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations in changes may be made by those skilled in the art without departing from the spirit of the invention. Accordingly, the foregoing detailed description should be considered exemplary in nature and not limited to the scope and spirit of the invention as set forth in the attached claims.

What is claimed is:

1. A method of playing a card game comprising:

providing at least one set of playing cards, each card in the set of the playing cards having a specific numeric value;

having at least one player make a wager;

dealing an initial hand of cards to the player and the dealer, the player's cards being face up and at least one of the dealer's cards being face down;

thereafter, having the player declare the player's hand either as a poker hand or a modified blackjack hand;

dealing additional cards to the player to enable the player to form a complete poker hand if the player declares his hand as a poker hand;

awarding winnings to the player based on the wager and a first payout schedule if the poker hand represented by the player's cards matches any one of a plurality of predetermined poker hands;

having the player forfeit his wager and withdraw from play if the player fails to achieve a winning poker hand;

determining if the total numeric value of the player's initial hand equals a first predetermined number if the player declares his initial hand as a modified blackjack hand, the first predetermined number being chosen from 31, 41 and 51;

determining if the total numeric value of the dealer's initial hand equals the first predetermined number;

paying winnings to the player based on the wager and a second payout schedule if the total numeric value of the player's initial hand equals the first predetermined number and the total numeric value of the dealer's initial hand is not equal to the first predetermined number;

dealing additional cards to the player upon the player's request;

having the player forfeit his wager and withdraw from play if the total numeric value of the player's hand exceeds the first predetermined number;

dealing additional cards to the dealer as long as the total numeric value of the dealer's hand is less than a second predetermined number which is less than the first predetermined number and requiring the dealer to hold as soon as the total numeric value of the dealer's hand is equal to or exceeds the second predetermined number; and paying winnings to the player based on the wager and the second payout schedule if the player has a winning hand.

2. The method according to claim 1 further comprising:

providing the winner of the modified blackjack card game with an opportunity to play in a subsequent card game with the dealer;

having the player make a wager that is equal to either half the amount of the winnings paid to the player or the full amount of the winnings paid to the player if the player assents to playing the dealer in the subsequent card game; and playing the subsequent card game.

3. The method according to claim 2 wherein the subsequent card game is high/low.

4. The method according to claim 1 wherein the first predetermined number is 31 and the second predetermined number is 25.

5. The method according to claim 1 wherein the predetermined poker hand is chosen from a pair, two pair, three of a kind, straight, flush, full house, four of a kind, five of a kind, straight flush and royal flush.

6. The method according to claim 1 wherein three cards dealt to the player and to the dealer in the initial deal.

7. The method according to claim 1 wherein four cards dealt to the player and to the dealer in the initial deal.

8. The method according to claim 1 wherein five cards are dealt to the player and to the dealer in initial deal.

9. The method according to claim 1 wherein the at least one set of playing cards includes at least one Joker Card.

* * * * *